United States Patent [19]

Grufman

[11] Patent Number: 4,714,134

[45] Date of Patent: Dec. 22, 1987

[54] SAFETY BELTS AND THE LIKE

[76] Inventor: Fredrik A. Grufman, 13, Larsbergsvägen, 181 38 Lidingö, Sweden

[21] Appl. No.: 872,655

[22] PCT Filed: Oct. 8, 1985

[86] PCT No.: PCT/SE85/00386

§ 371 Date: Jun. 10, 1986

§ 102(e) Date: Jun. 10, 1986

[87] PCT Pub. No.: WO86/02278

PCT Pub. Date: Apr. 24, 1986

[30] Foreign Application Priority Data

Oct. 10, 1984 [SE] Sweden ..... 8405074

[51] Int. Cl.[4] ..... A62B 1/16

[52] U.S. Cl. ..... 182/3

[58] Field of Search ..... 182/3-8; 135/120; 24/129 R, 481, 482

[56] References Cited

U.S. PATENT DOCUMENTS

| | | | |
|---|---|---|---|
| 1,892,611 | 12/1932 | Dawes | 135/120 |
| 2,254,179 | 8/1941 | Hoyt | 182/7 |
| 2,412,895 | 12/1946 | Lewis | 182/3 |
| 3,941,208 | 3/1976 | St. Germain | 182/3 |
| 4,477,948 | 10/1984 | Sachs | 24/129 R |

FOREIGN PATENT DOCUMENTS

| | | |
|---|---|---|
| 195687 | 7/1974 | Fed. Rep. of Germany . |
| 367546 | 4/1974 | Sweden . |

*Primary Examiner*—Reinaldo P. Machado
*Attorney, Agent, or Firm*—Finnegan, Henderson, Farabow, Garrett & Dunner

[57] ABSTRACT

A safety belt comprises a first rope and a hose-shaped second rope. The inner diameter of the second rope expands radially when compressed axially and contracts radially when extended axially. The second rope includes axially spaced apart openings defining a tubular lead-through therebetween. The first rope passes through the openings of the second rope so that a portion of the first rope is contained in the lead-through. The second rope is looped around the first rope to form knotted portions surrounding the openings. Moving the knotted portions toward each other permits the first rope to move axially through the lead-through of the second rope, and moving the knotted portions away from each other locks the lead-through to the portion of the first rope contained in the lead-through. In a second embodiment the knotted portions of the second rope are replaced by tubular housings fixed to the second rope.

7 Claims, 3 Drawing Figures

SAFETY BELTS AND THE LIKE

The present invention refers to an improvement in safety belts and the like of the kind which comprise a rope or a similar elongated, flexible means which is threaded through one or several lead-troughs from which latter at least one is designed as a locking device for the rope. More specifically the invention refers to that particular kind of safety belt where the flexible element is hollow and has the characteristic that it when axially compressed will expand radially thus increasing the inner diameter thereof but is contracted radially consequently diminishing the inner diameter thereof when exposed to an axial pulling action. In the following the flexible element will be referred to as hose but in practice it usually consists of a rope which is made by braiding yarn, plastic strips or the like.

The Swedish Pat. No. 367 546 describes a safety belt in which the locking of the rope is achieved by threading a first strand of the rope through a second strand thereof where the first rope strand is introduced through a first opening in the second rope strand, extends inside the latter a certain length and leaves it through a second opening.

A locking device of this character has a number of advantages from which the effective locking action and the neglectible wear for which the rope is exposed may be mentioned.

A drawback of the known device however is that the rope will be weakened in the region of the openings.

The object of the invention has thus primarily been to eliminate this drawback and to achieve this and further objects the invention has the characteristics of the patent claims.

In the accompanying drawing an exemplary embodiment of the invention is illustrated.

Figure 1:
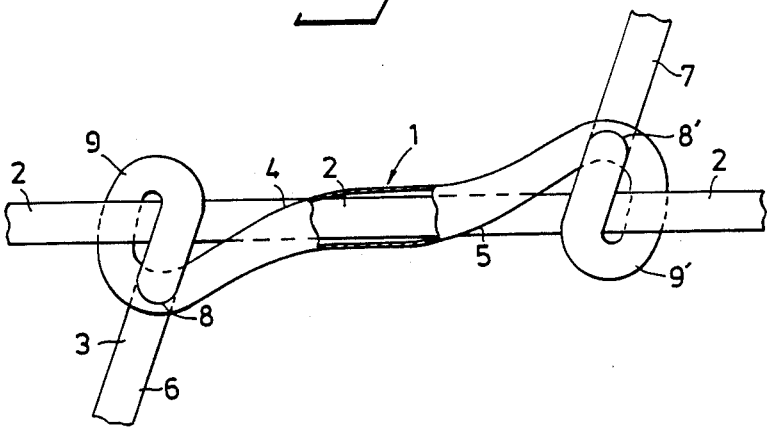
Figure 3:
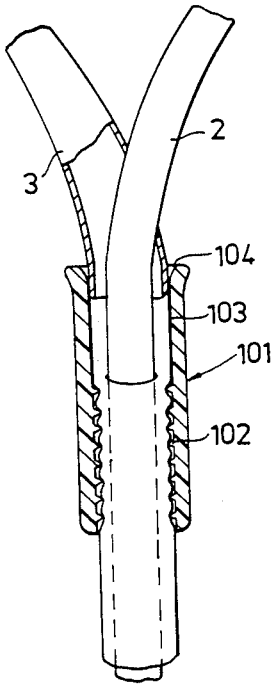
Figure 2:
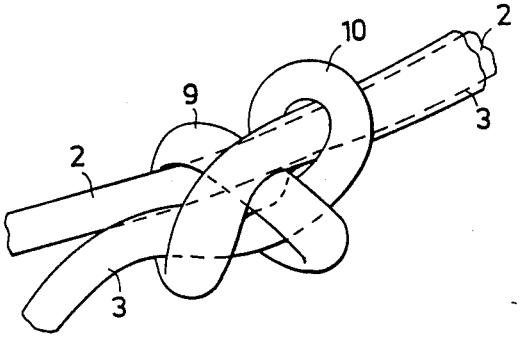

FIG. 1 schematically shows a part of a safety belt or the like with a lead-through with locking device according to a first embodiment of the invention FIG. 2 in perspective shows a lead-through with locking device according to a second embodiment and FIG. 3 finally is a schematical longitudinal section through a lead-through with locking device according to a third embodiment.

Although the invention primarily refers to a safety belt it will also—which will be apparent from the following—lend itself to use in all applications in which a rope or rope strand is guided through a lead-through to which it may be locked.

In the embodiment illustrated in FIG. 1 the numeral 1 generally designates a lead-through for a first hose 2. The lead-through then consists of a second hose 3, which may be a separate part or a part of the first hose 2 which then preferably is formed to a loop. In said second hose there is provided a first opening 4 through which the first hose extends into the second hose and a second opening 5, located at an axial distance from the first opening and the first hose passes out of the second hose through said second opening.

In the illustrated example the second hose 3 forms a free lower part 6 and a free upper part 7 but said free parts 6 and 7 are respectively threaded through openings 8, 8' in the second hose 3 after having formed respective knots 9, 9' which substantially surround the openings 4 and 5, respectively. A reinforcement of the lead-through 1 in the weakened portions thereof where the first hose 2 passes through the second hose 3 is achieved hereby which means that the drawback of the known construction referred to is eliminated in a very simple manner.

To operate the device just described the knot 9 at the left in the drawing is manually moved towards the other knot 9' when it is desired to pull the first hose 2 through the lead-through 1.

Owing to the fact that the portion of the second hose which is located between the knots 9 and 9' at this operation will be compressed axially, the inner diameter thereof will be widened such that the first hose 2 may pass through the lead-through 1 unobstructed.

When the first rope has been pulled out as much as desired the adjustment made will be secured by simply pulling the knot 9 away out from the knot 9' causing the portion of the hose 3 which is located between the knots to provide by means of axial expansion thereof a radial compression of said second hose in this region thus causing the locking of the first hose.

The embodiment shown in FIG. 2 differs from the embodiment just described in that the second hose 3 after having formed the knot 9 is wound one further winding 10 around the mouth portion of the lead-through and is then carried out through the knot 9.

The embodiment of FIG. 3 is equal in regards of function and construction to the embodiment shown in FIG. 1 with the exception that each of the respective knots 9 and 9' has been replaced by a tubular housing 101, preferably made from plastic material and provided to receive that portion of the second hose 3 through which the first hose 2 is carried. The tubular housing has a first inner portion 102 provided with grooves, barbs or the like. Each housing 101 extends substantially to one of the openings 4, 5 in the second hose and has a second, plain inner adjoining portion 103 which ends in a rounded outlet portion 104. In FIG. 3 only one housing 101 is shown but it is obvious that in a lead-through of the kind shown in FIG. 1 two such housings located at an axial distance from each other are required.

It is evident that the knots 9 and 9' and the housings 101 at the same time as they provide the desired reinforcement also serve as handles for operating the locking device and that FIG. 2 for the sake of clearness shows the rope winding in a not tightened condition.

I claim:

1. A safety belt, comprising:

a first rope; and a hose-shaped second rope rope having an inner diameter that expands radially at times when said second rope is compressed axially and contracts radially at times when said second rope is extended axially, said second rope including axially spaced apart first and second openings defining a tubular lead-through therebetween, said first rope passing through said first and second openings of said second rope so that a portion of said first rope is contained in said lead-through, said second rope being looped around said first rope to form first and second knotted portions respectively surrounding said first and second openings;

whereby moving said first and second knotted portions toward each other permits said first rope to move axially through said lead-through of said second rope and moving said first and second knotted portions away from each other locks said lead-through to said portion of said first rope contained in said lead through.

2. The safety belt of claim 1, wherein said second rope includes a pair of through holes on axially opposite sides of said first and second openings, said second rope being threaded through said through holes at said first and second knotted portions.

3. The safety belt of claim 2, wherein said second rope looped around said first rope at least twice at each of said first and second knotted portions.

4. A safety belt, comprising:

a first rope;

a hose-shaped second rope having an inner diameter that expands radially at times when said second rope is compressed axially and contracts radially at times when said second rope is extended axially, said second rope including axially spaced apart first and second openings defining a tubular lead-through therebetween, said first rope passing through said first and second openings of said second rope so that a portion of said first rope is contained in said lead-through, said second rope being looped around said first rope to form first and second knotted portions respectively surrounding said first and second openings; and first and second tubular housings encircling said second rope at said first and second openings respectively, each of said first and second housings including an attachment portion fixed to said second rope axially between said first and second openings, whereby moving said first and second housings toward each other permits said first rope to move axially through said lead-through of said second rope and moving said first and second housing away from each other locks said lead-through to said portion of said first rope contained in said lead-through.

5. The safety belt of claim 4, wherein each of said first and second housings includes a rounded outlet portion respectively adjacent said first and second openings of said second rope.

6. The safety belt of claim 4, wherein said attachment portions of said first and second housings include barbs engaging said second rope.

7. The safety belt of claim 6, wherein each of said first and second housings includes a rounded outlet portion respectively adjacent said first and second openings of said second rope and a smooth bore between said outlet portion and said attachment portion.

* * * * *